US005455976A

United States Patent [19]

Kim et al.

[11] Patent Number: 5,455,976

[45] Date of Patent: Oct. 10, 1995

[54] APPARATUS FOR AUTOMATICALLY BRUSHING CHALK POWDER OFF FROM A BLACKBOARD ERASER

[75] Inventors: Se W. Kim; Eon S. Kim, both of Kyonggido, Rep. of Korea

[73] Assignee: Kim; Eon S., Kyonggido, Rep. of Korea

[21] Appl. No.: 318,509

[22] Filed: Oct. 5, 1994

[30] Foreign Application Priority Data

Oct. 6, 1993 [KR] Rep. of Korea ..... 93-20632

[51] Int. Cl.[6] ..... B43L 21/02; A47L 25/00

[52] U.S. Cl. ..... 15/88.3; 15/89; 15/311

[58] Field of Search ..... 15/311, 21.1, 40, 15/88.2, 88.3, 88.4, 89, 91

[56] References Cited

U.S. PATENT DOCUMENTS

| | | | |
|---|---|---|---|
| 2,306,911 | 12/1942 | Schaefer | 15/311 |
| 3,411,175 | 11/1968 | Mills | 15/311 |
| 4,549,327 | 10/1985 | Johnson | 15/236 |
| 5,075,915 | 12/1991 | Rodriguez | 15/89 |

FOREIGN PATENT DOCUMENTS

| | | |
|---|---|---|
| 51-1871 | 1/1976 | Japan . |
| 52-12491 | 3/1977 | Japan . |
| 52-22348 | 5/1977 | Japan . |
| 1989-4786 | 7/1989 | Rep. of Korea . |

*Primary Examiner*—Edward L. Roberts
*Attorney, Agent, or Firm*—Flynn, Thiel, Boutell & Tanis

[57] ABSTRACT

The invention relates to an apparatus for brushing chalk powder off from an eraser surface of a blackboard eraser in which elastic brushes attached to rotatable shafts of rotatable bodies are brushingly engaged with the eraser surface and are rotated in forward and reverse directions by a motor so that the chalk powder removed from the eraser is collected in chalk powder receiving containers. After the passage of a set time interval, the operation of the apparatus is automatically stopped. A chalk powder containing eraser and the now clean eraser inside the apparatus can be exchanged. Thus, dispersion of powder into the room is prevented.

6 Claims, 9 Drawing Sheets

APPARATUS FOR AUTOMATICALLY BRUSHING CHALK POWDER OFF FROM A BLACKBOARD ERASER

FIELD OF THE INVENTION

The present invention relates to an apparatus for automatically brushing chalk powder off from a blackboard eraser and, in particular, to an apparatus for automatically brushing chalk powder off from a blackboard eraser in which rotatable shafts having elastic brushes attached thereto elastic brushes are rotated in forward and reverse directions by an electric motor and the chalk powder is effectively collected in chalk powder-receiving containers so that dispersion of chalk powder by air current into the room is prevented.

BACKGROUND OF THE INVENTION

In general, characters written with a piece of chalk onto a blackboard are wiped away by a blackboard eraser and then the blackboard eraser having the chalk powder thereon is brushed off usually outside of a room window. At this time, chalk powder brushed off from the eraser is dispersed into the air and air in the room usually becomes polluted by the chalk powder. Breathing the polluted chalk powder containing air is bad for one's health.

Further, in order to overcome such problems, there have been provided a variety of devices for brushing the chalk powder from the eraser. However, most of the devices effect a removal of the chalk powder by rubbing the erasers having the powder thereon in the devices by hand.

One prior art device effects a removal of the chalk powder from the eraser by operating a brushing off rod having sharp protrusions and through holes up and down by an electric motor (Korean Utility Model Publication No. 1989-4786 publicated on Jul. 20, 1989). However, such a device has drawbacks due to the structure being complex and large in size, thereby occupying large spaces and are high in cost.

SUMMARY OF THE INVENTION

It is an object of the invention to provide an apparatus for automatically brushing chalk powder off from a blackboard eraser to thereby prevent a dispersion of chalk powder into the surrounding air when the inventive apparatus is used in the room, and at the same time the room air is maintained in a good healthy state. More specifically, the apparatus includes a housing having an opening into an interior of the housing and being adapted to receive the eraser surface of the blackboard eraser therein. A plurality of parallel shafts rotatably supported in the housing are provided, each shaft having eraser surface engaging brush elements thereon. A coupling device is provided for coupling a drive mechanism to the plural shafts. A switch is provided which is responsive to the presence of the blackboard eraser in the opening. A closure is supported for open and closed relation relative to the opening in the housing. Structure is provided for effecting a movement of the closure member to the open position relative to the opening in response to an entry of the eraser surface into the opening and an initiating of the rotation of the shafts to cause the brush elements to brushingly engage the eraser surface. A collecting device is provided for collecting the chalk powder brushed off from the eraser surface.

BRIEF DESCRIPTION OF THE DRAWINGS

Other objects and purposes of the invention will become understood from the following description with reference to the accompanying drawings, in which.

DETAILED DESCRIPTION

Figure 1:
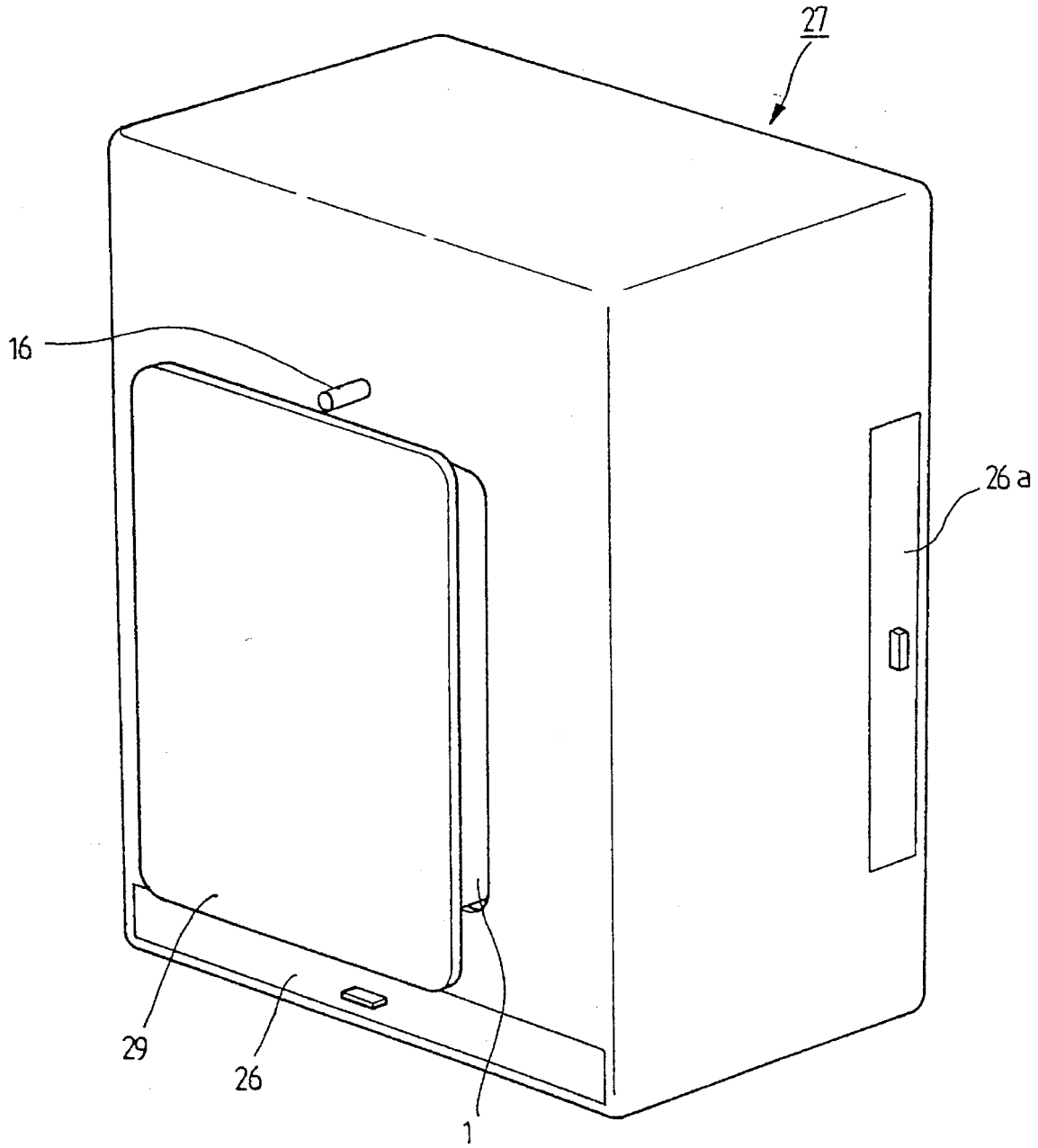
FIG. 1 shows an entire perspective view of an apparatus for automatically brushing chalk powder off from a blackboard eraser according to the present invention.

The invention comprises an apparatus having a housing with an opening 1 in a front surface thereof. A driving means, namely, an electric motor 2, is fixedly oriented on the interior of the housing. A plurality of rotatable bodies 7, 8, 9 and 10 are also provided in the housing and supported on a support stand 6. Each rotatable body 7, 8, 9 and 10 has a pulley 7*a*, 8*a*, 9*a* and 10*a*, respectively, thereon. A pulley 4 is disposed on a motor shaft 3 of the motor 2 and a belt 5 is interlocked with the pulley 4 and the pulley 7*a* of the rotatable body 7, the pulley 7*a* of the body 7 and the pulley 8*a* of the body 8, the pulley 8*a* of the body 8 and the pulley 9*a* of the body 9, the pulley 9*a* of the body 9 and the pulley 10*a* of the body 10 being mutually interlocked respectively, with belts 5*a*, 5*b* and 5*c*, and elastic brushes 11 are fixedly attached to the rotatable shafts 7*b*, 8*b*, 9*b* and 10*b* of the bodies 7, 8, 9 and 10 respectively.

A rectangular hole 13*a* is provided in a sliding member 13 disposed on fixed shaft 12*a* on the top portion of the guide member 12. The sliding member 13 formed integrally with an operating shaft 13*b* slidably received in inclined grooves 19 and 19*a* respectively provided in switching members 21 and 21*a*. The upper end of the slide member 13 is engaged by one end of a spring 14, the other end of the spring abutting against an inside wall of the housing. A push button 16 is operatively connected to the slide member 13 for operating the sliding member 13 and against an elastically yieldable support provided by a tension spring 17. Switching members 21 and 21*a* are pivotally supported on the shaft 12*a* received in shaft holes 18 and 18*a* provided therein. Elastic bars 20 and 20*a* are fixed at one end to switching doors 23 and 23*a* which are interlocked to the switching members 21 and 21*a* through the elastic bars 20 and 20*a* connected thereto at the other end thereof by connecting rings 22 and 22*a*. A pair of guide rollers 24 and 24*a* are disposed on and along a bottom edge of the switching doors 23 and 23*a* and are guided in guide rails 25 and 25*a*.

A main body 27 of the housing has containers 26 and 26*a* therein into which is disposed chalk powder. The containers 26 and 26*a* are oriented adjacent the bottom and the rear surface. A blackboard eraser 29 has magnets 28 and 28*a* attached in the interior thereof in order to initiate a drive of the driving means. The eraser 29 also is adapted to press against a push button 16 of the switching means protruding from the front surface of the main body 27.

Figure 6:
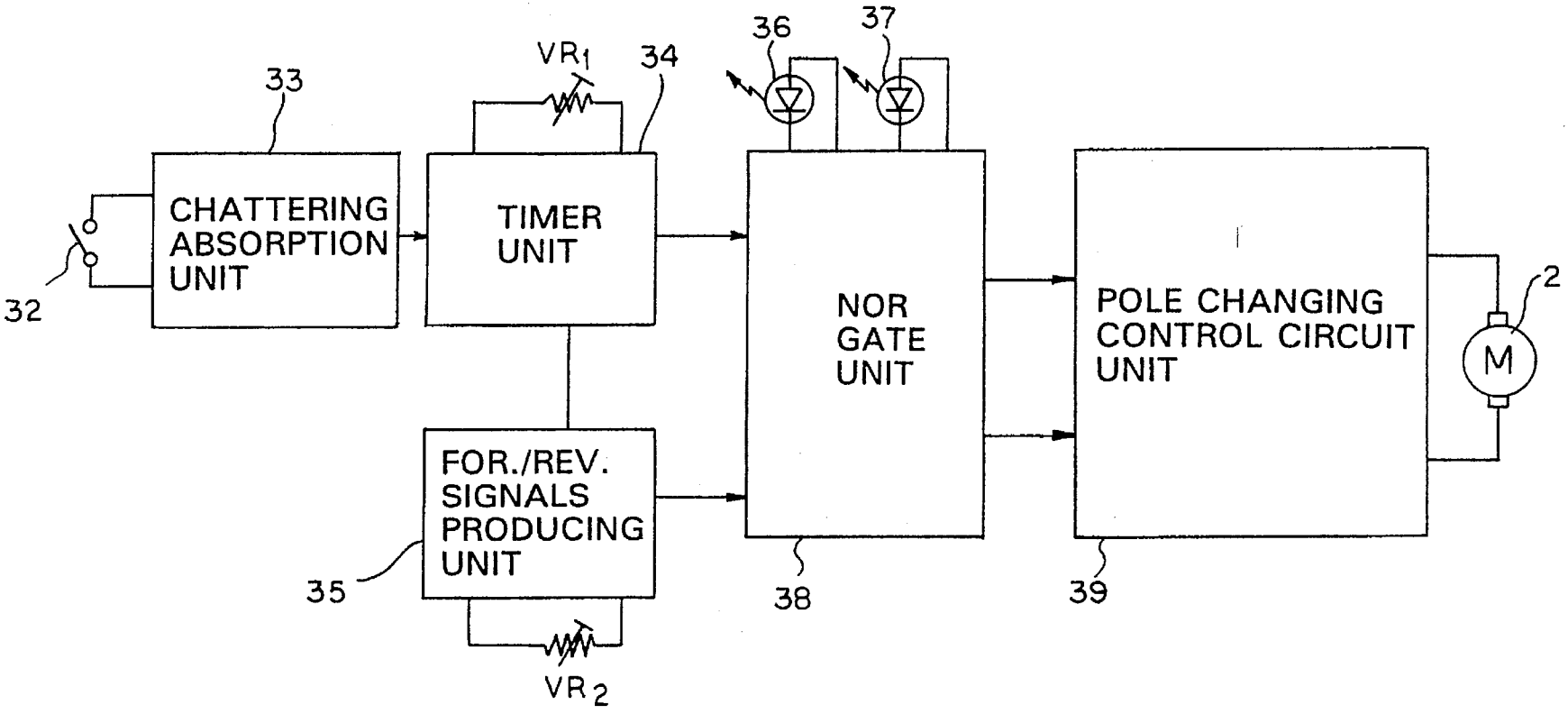
FIG. 6 shows a block electrical diagram according to the present invention.
Figure 7:
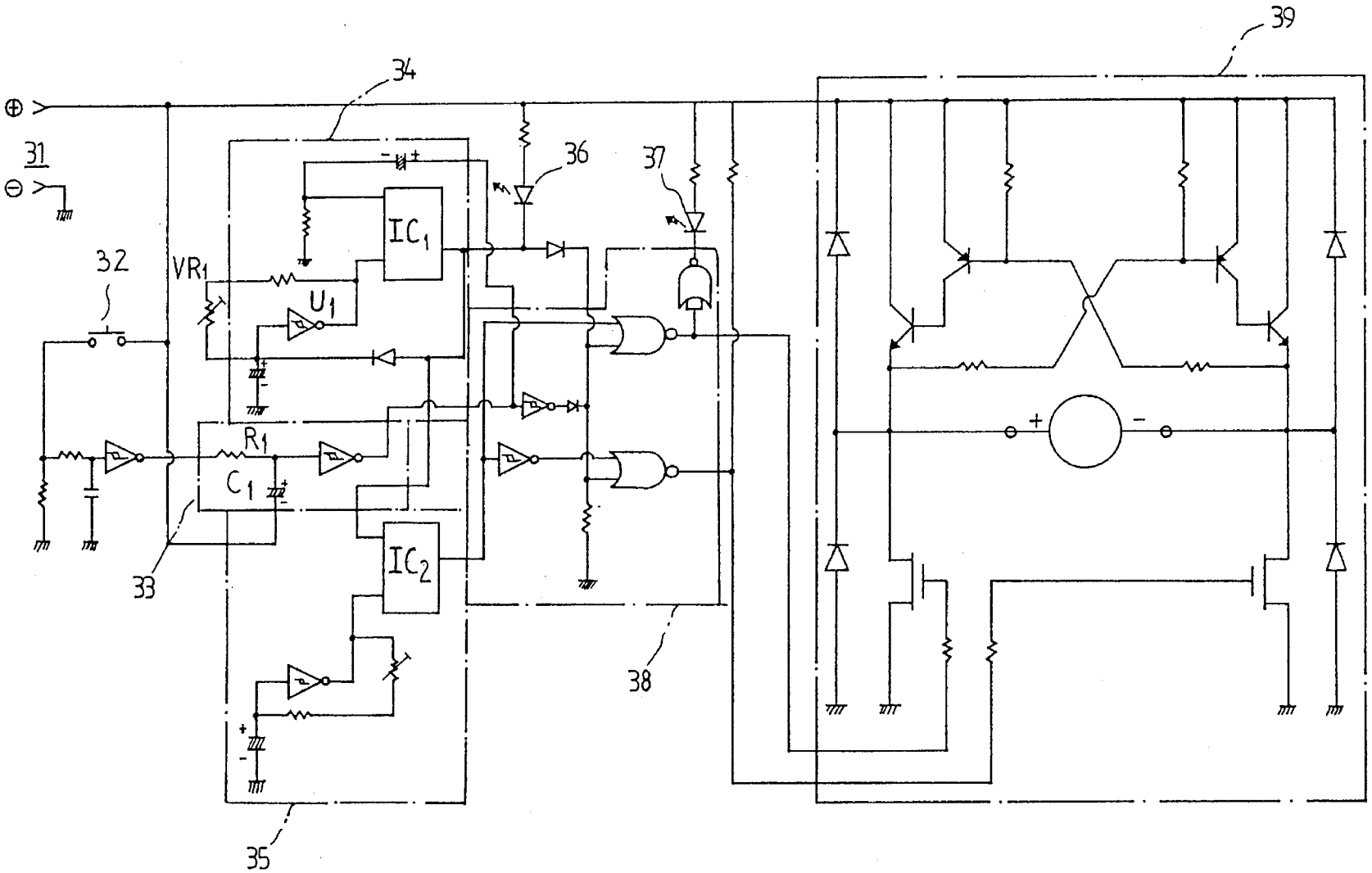
FIG. 7 shows an electrical circuit diagram of FIG. 6.
Figure 8:
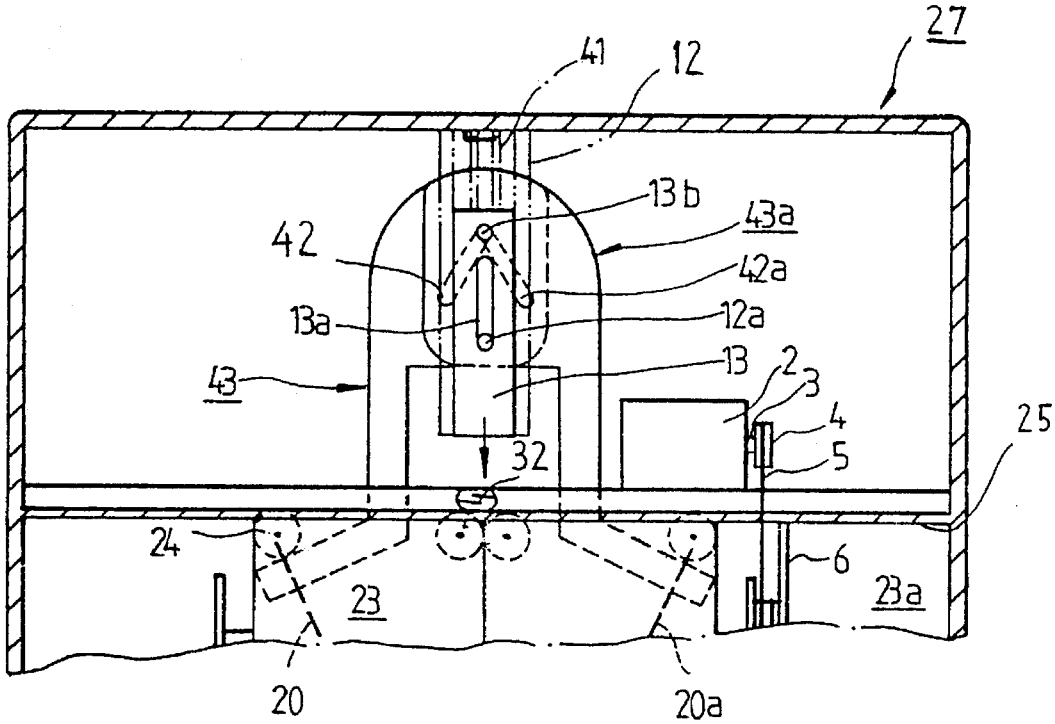
FIG. 8 shows a cross-sectional view of another embodiment according to the present invention, in which the switching doors are in closed state.
Figure 9:
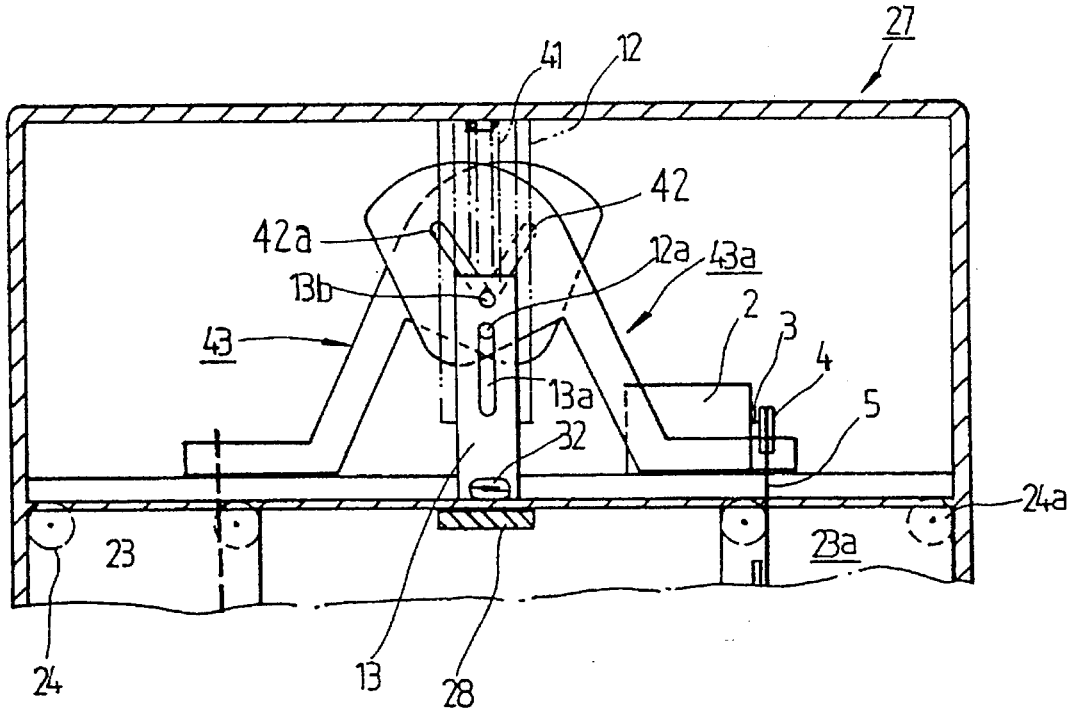
FIG. 9 shows a cross-sectional view of another embodiment according to the present invention, in which the switching doors are in open state.
Figure 10:
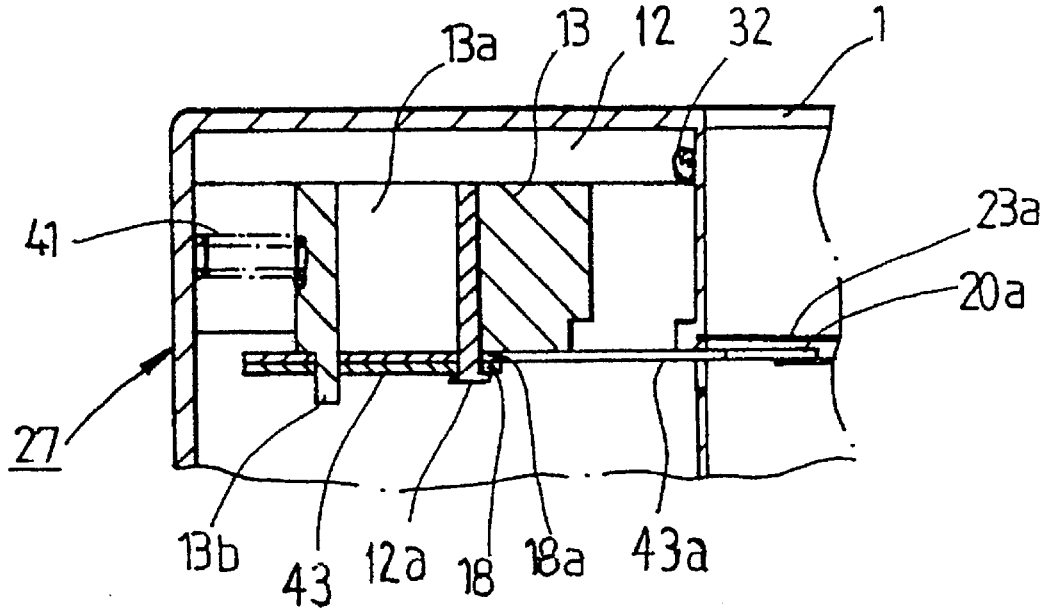
FIG. 10 shows a longitudinal sectional view of FIG. 8.
Figure 11:
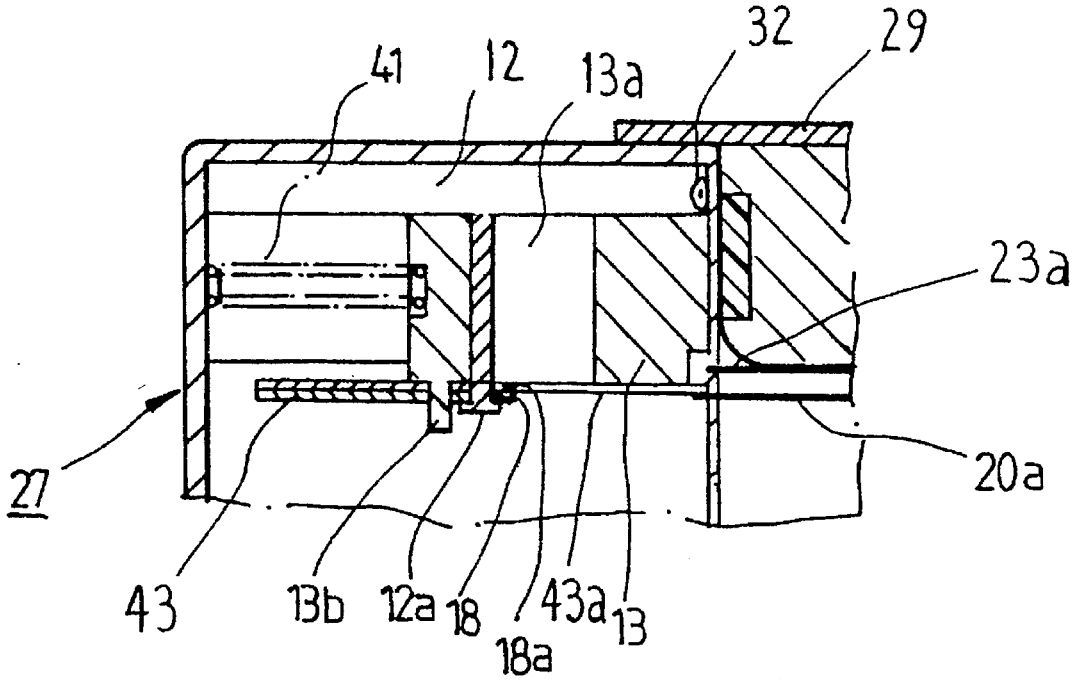
FIG. 11 shows a longitudinal sectional view of FIG. 9.

FIG. 6 and FIG. 7 show a block diagram and an electrical circuit diagram, respectively, according to the invention. A pole changing control circuit unit 39 of the invention on the block diagram and the circuit diagram are connectible to a power source 31. An access switch 32 is switchable ON and OFF to control power from the power source 31. An electrical spike absorption unit 33 absorbs or suppresses the electrical spike produced when the switch 32 is rendered ON and an ON signal is produced. A timer unit 34 receives the ON signal from the unit 33 and outputs a signal during time intervals controlled by a variable register $VR_1$. A forward and reverse signal producing unit 35 receives signals from the unit 34 and outputs forward and reverse signals with a spacing controlled by a setting value on the variable register $VR_2$. A NOR gate unit 38 receives output signals from the timer unit 34 and the signal producing unit 35 outputs a driving signal to a timer display LED 36 and a direction display LED 37 and divides them as forward and reverse signals for the motor 2. A motor 2 is supplied with power to rotate the motor in the forward and reverse directions by the output signals from the NOR gate unit 38.

FIGS. 8 to 11 show another embodiment according to the invention. Identical structure in FIGS. 1 to 7 and FIGS. 8 to 11 have identical reference numerals and the description therefor is omitted. The different structures have switching members 43 and 43*a* in FIGS. 8 to 11.

In the apparatus of FIGS. 8 to 11, the switching members 43 and 43*a* are operated by the sliding member 13 slidably received in the rectangular hole 13*a* and the operating shaft 13*b* is integrally formed on the guide member 12 having the fixed shaft 12*a* on a top portion thereof. A side of the slide member is connected to a tension spring 41. Inclined grooves 42 and 42*a* are provided in the switch members 43, 43*a* and are oriented in an inversed V shape and slidably engaged with the operating shaft 13*b*. Shaft holes 18 and 18*a* are provided in the switching members 43, 43*a* and receive therein the fixed shaft 12*a*. Elastic bars 20 and 20*a* are fixed to respective ends each thereof to the switching members 43 and 43*a* and the closure members 23, 23*a*.

OPERATION

The operation and effect of the invention embodying the above described structures will be now described below for convenience.

A blackboard eraser 29 having the magnets 28 and 28*a* attached to the top and bottom thereof is inserted into the opening 1 in the main body 27 and at the same time a circumferentially projecting rim extending around the eraser 29 is pressed against the push button 16 which protrudes from the front surface of the main body 27. The access switch 32 is switched to the ON state by the magnets 28 and 28*a* now positioned adjacent thereto.

Accordingly, when the circumferentially projecting rim on the eraser 29 is pressed against the push button 16 and to cause a movement of the push button into the main body 27, the tension spring 17 urging the push button to its initial position is elastically tensioned. The push button 16 is moved toward the rear of the main body 27 in the arrow direction shown in FIG. 4. At the same time the movement of the push button causes the sliding member 13, which is slidably supported on the guide member 12, to be lifted against the return force of the compression spring 14.

Figure 2:
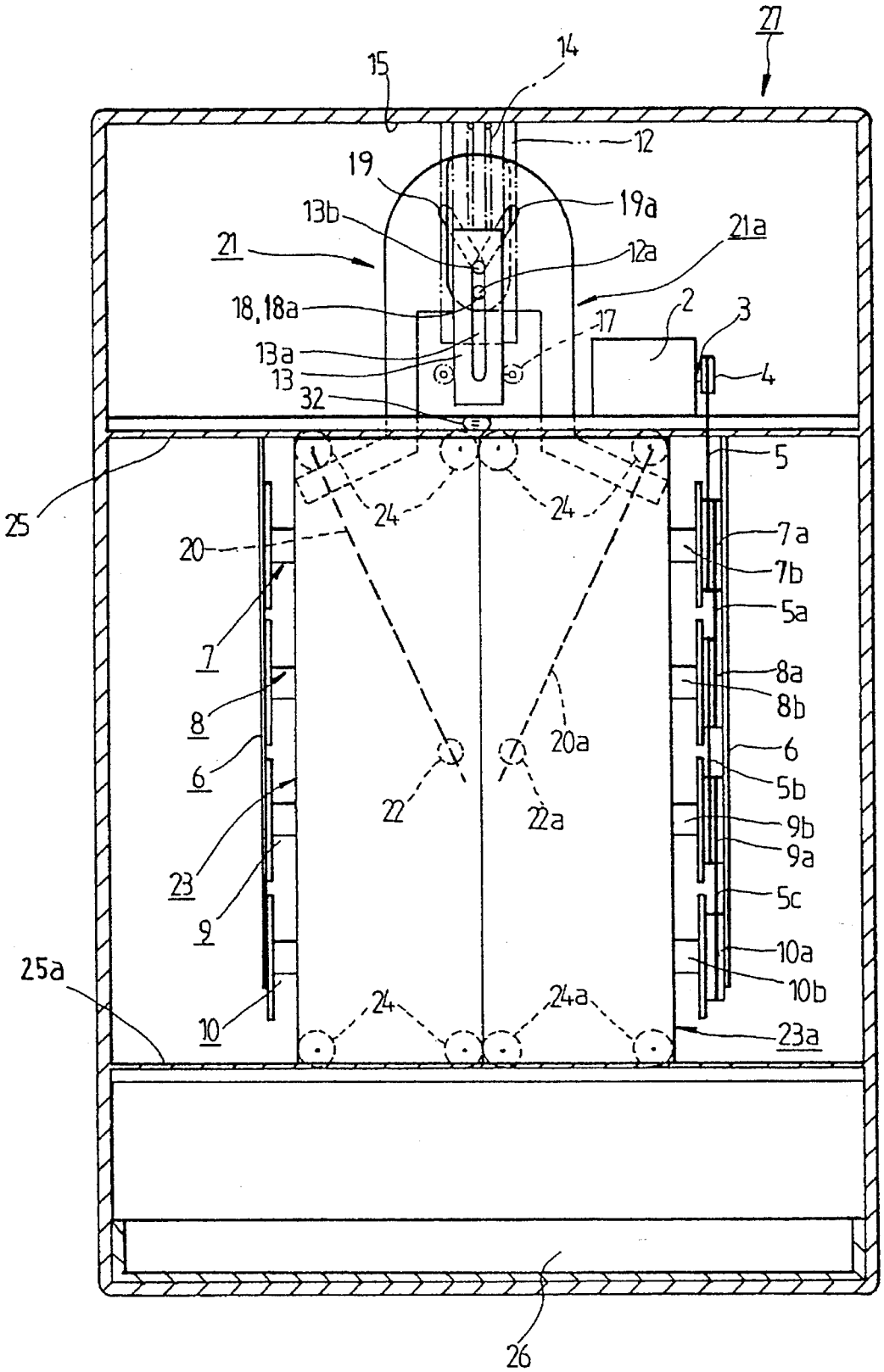
FIG. 2 shows a cross-sectional view of FIG. 1 in which the switching doors are in the closed state.
Figure 3:
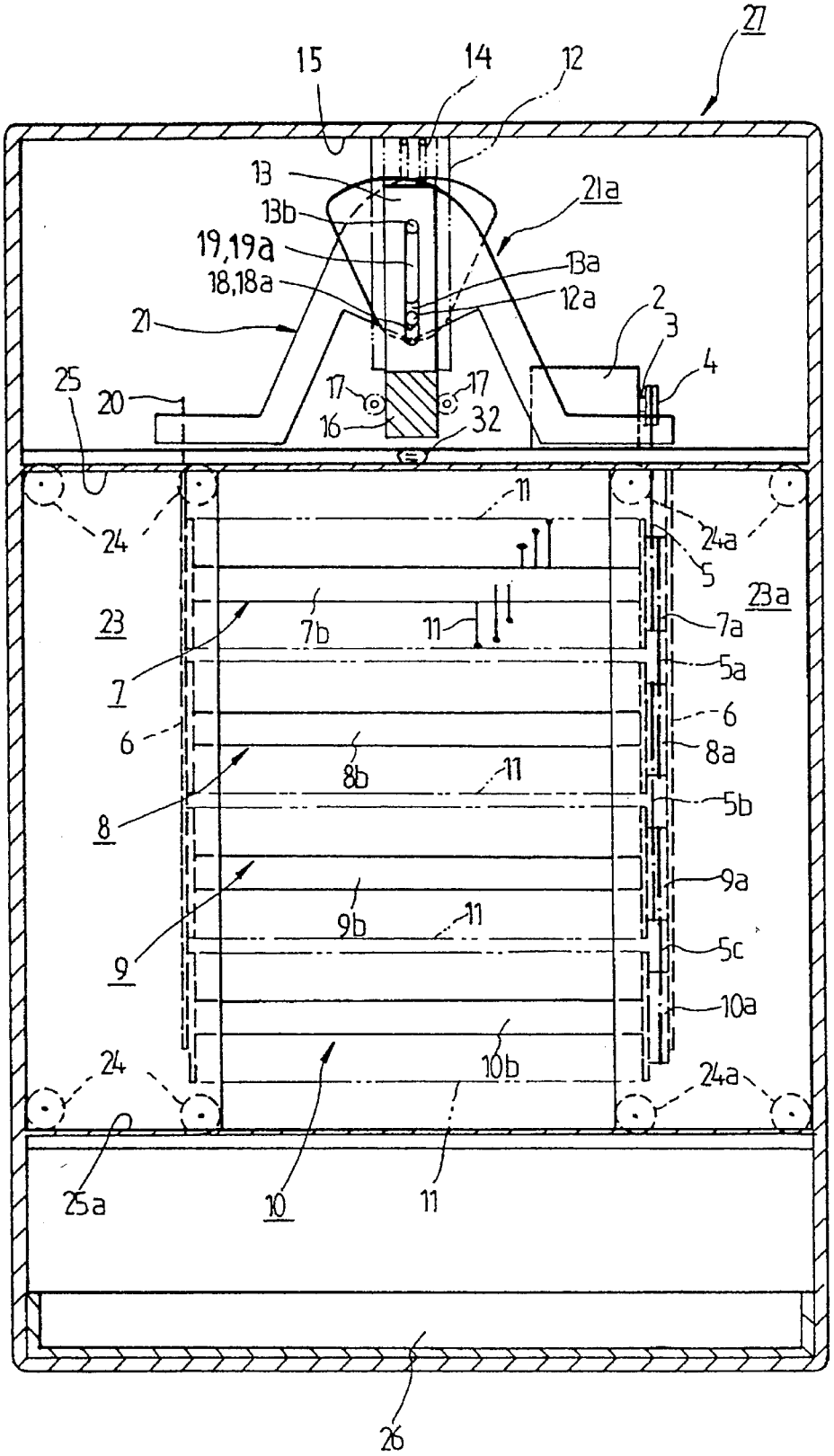
FIG. 3 shows a cross-sectional view of FIG. 1, in which the switching doors are in the open state.

At this time, the side-by-side switching members 21 and 21*a* which are rotatably disposed on the fixed shaft 12*a* on the guide member 12 are rotated in opposite directions about the fixed shaft 12*a*. The operating shaft 13*b* integrally formed on the sliding member 13, and received in the oppositely inclined grooves 19 and 19*a* provided on the switching members 21 and 21*a* as shown in FIGS. 2 and 3, causes the rotation of the switching members 21 and 21*a* when the sliding member 13 is lifted.

The closure doors 23 and 23*a* are moved to both sides of the main body 27 guided by guide rollers 24 on the doors received in laterally extending guide rails 25 and 25*a* provided on the main body 1. Elastic bars 20 and 20*a* connected respectively to and extend between the closure doors 23 and 23*a* and the switch members 21 and 21*a* facilitate a full movement of the doors to both sides of the main body 27 when the switching members 21 and 21*a* are rotated in their respective opposite directions by the push button 16. The opening of the closure doors 23 and 23*a* is controlled by the aforesaid structure so that the eraser surface will engage the elastic brush elements 11 only after the doors have been fully open.

Further, FIGS. 8 to 11 show another embodiment of the apparatus wherein the switching means of the invention and the operation thereof will be described below. The magnets 28 and 28*a* on the eraser are attached to the opposite sides, here top and bottom, of the eraser inserted in the opening 1 into the main body 1, and at the same time the sliding member 13 is moved by the magnets 28 and 28*a* as in an arrow direction of FIG. 8, and the state of the access switch 32 is changed to the ON state by the magnets 28 and 28*a*. That is, when the eraser 29 is inserted into the opening 1, the magnetic force of the magnets 28 and 28*a* attached to the top and bottom of the eraser 29 cause the sliding member 13 to be moved and attracted as shown on FIGS. 8 and 9. At this time, the moving sliding member 13 tensions the spring 41. At the same time, the operating shaft 13*b* which is integrally formed on the sliding member 13 is moved and the orientation of the inclined grooves 42 and 42*a* on the switching member 43 and 43*a* to be changed from an upside-down "V" form to a "V" form and as the switching members 43 and 43*a* are rotated around the fixed shaft 12*a* as shown on FIGS. 8 and 9. Thus, the closure doors 23 and 23*a* are moved toward the sides of the main body 27 in response to a rotation of the switching members 43 and 43*a* by the elastic bars 20 and 20*a* which are fixed at one end thereof to the switching members 43 and 43*a* and at the other end thereof to the closure members 23, 23*a*.

At this time, a pair of guide rollers 24 and 24*a* which are disposed adjacent a bottom edge of the closure doors 23 and 23*a* are guided along the guide rails 25 and 25*a* on the main body 27, thereby effecting an aligned operation of the closure doors 23 and 23*a*.

Therefore, and as described above, the closure doors 23 and 23*a* are opened and, at the same time, the state of the access switch 32 disposed on the main body 27 and caused by presence of the magnets 28 and 28*a* attached to the top and bottom of the eraser 28, is changed to the ON state.

Thus, when the access switch 32 is in the ON state, the spike which is produced from the access switch 32 is absorbed by the resistor $R_1$ and condenser $C_1$ in the spike absorption unit 33, and an ON signal is outputted to the timer unit 34 through a NOR gate ($U_1$).

The timer unit 34 which received signals from the spike absorption unit 33 transfers signals to the NOR gate unit 38 and the forward and reverse signal producing unit 35 during the times of the setting values of the variable register $VR_1$ (that is, 5 to 30 seconds), and when the signals reach the set value on the variable register $VR_1$, output of the signals is stopped.

Further, when ON signals from the spike absorption unit 33 are stopped, that is, the access switch 32 is in the OFF state, the signal-output to the NOR gate unit 38 and the signal producing unit 35 is stopped even though the time out setting on the variable register $VR_1$ on the timer unit 34 has not reached the set values thereof.

The forward and reverse signal producing unit 35 which receives signals from the timer unit 34 produces the forward and reverse signals with a spacing set by the setting values of the variable register $VR_2$ (that is, 0.5 to 5 seconds) and is transferred to the NOR gate unit 38.

Accordingly, the NOR gate unit 38, which receives signals from the timer unit 34 and the signal producing unit 35, drives the timer display LED 36 and the direction display LED 37, and divides the forward and reverse signals to the motor 2 by outputting signals to the pole changing control circuit unit 39.

Thus, the pole changing control circuit unit 39 supplies power for the forward or reverse direction of the motor 2 in response to the forward or reverse signal which is received from the NOR gate unit 38 to cause the motor 2 to be rotated.

When the access switch 32 is in the ON state by such operation, the motor 2 is rotated in the forward and reverse directions caused by the set spacing of the variable register $VR_2$ in the signal producing unit 35 for the time set on the variable register $VR_1$ in the timer unit 34.

Accordingly, the pulley 4 on the shaft 3 of the motor 2 which is interlocked with the pulley 7*a* on the rotating body 7 by the belt 5, reciprocally drives the rotatable body 7 which is rotatably disposed on the supporting stand 6. The forward and reverse rotation of the motor 2 thereby causes the rotating body 7 to also be rotated in the forward and reverse directions.

In addition, the remaining rotating bodies 8, 9 and 10, the pulley 7*a* of the body 7 and the pulley 8*a* of the body 8, the pulley 8*a* of the body 8 and the pulley 9*a* of the body 9, and the pulley 9*a* of the body 9 and the pulley 10*a* of the body 10 are mutually interlocked by belts 5*a*, 5*b* and 5*c*, respectively, thereby the bodies 7, 8, 9 and 10 also are rotated in the forward and reverse directions by the forward and reverse rotations of the motor 2.

At the same time, because the elastic brushes 11 are attached to the rotating shafts 7*b*, 8*b*, 9*b*, and 10*b* of the bodies 7, 8, 9 and 10, respectively, the elastic brushes brush powder off from an eraser surface on the eraser 29 having the chalk powder thereon when the bodies 7, 8, 9, and 10 are rotated.

Further, the elastic brushes 11 are made of rubber materials. However, all other materials which brush away from the eraser surface of the eraser 29 chalk powders are also within the scope of the present invention.

When the effect caused by the elastic brushes 11 brushing chalk brush powder off from the eraser surface of the eraser is unchanged even when the leading ends of the brushes 11 are thick in thickness.

Accordingly, the chalk powder removed from the eraser surface of the eraser 29 is accumulated in the chalk powder receiving containers 26 and 26*a* on the bottom and the rear surface of the main body 27. When the set time determined by the variable register $VR_1$ in the timer unit 34 times out, the signals from the NOR gate unit 38 and the signal producing unit 35 are stopped and the operation is finished.

In addition, by necessity, when the eraser 29 is inserted into the opening 1 of the main body 27, the operation as described above can be repeatably accomplished.

Figure 4:
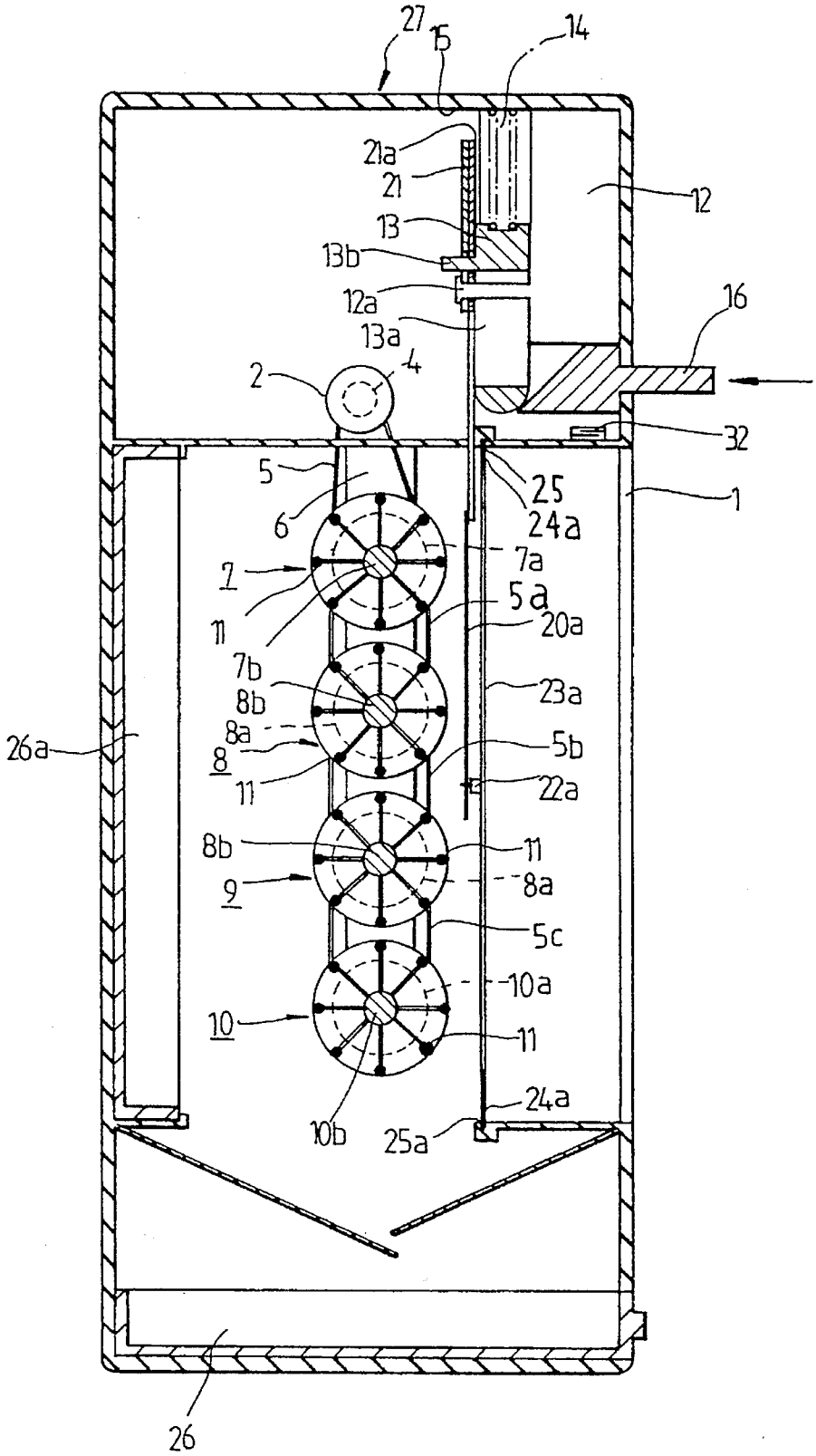
FIG. 4 shows a longitudinal sectional view of FIG. 2.
Figure 5:
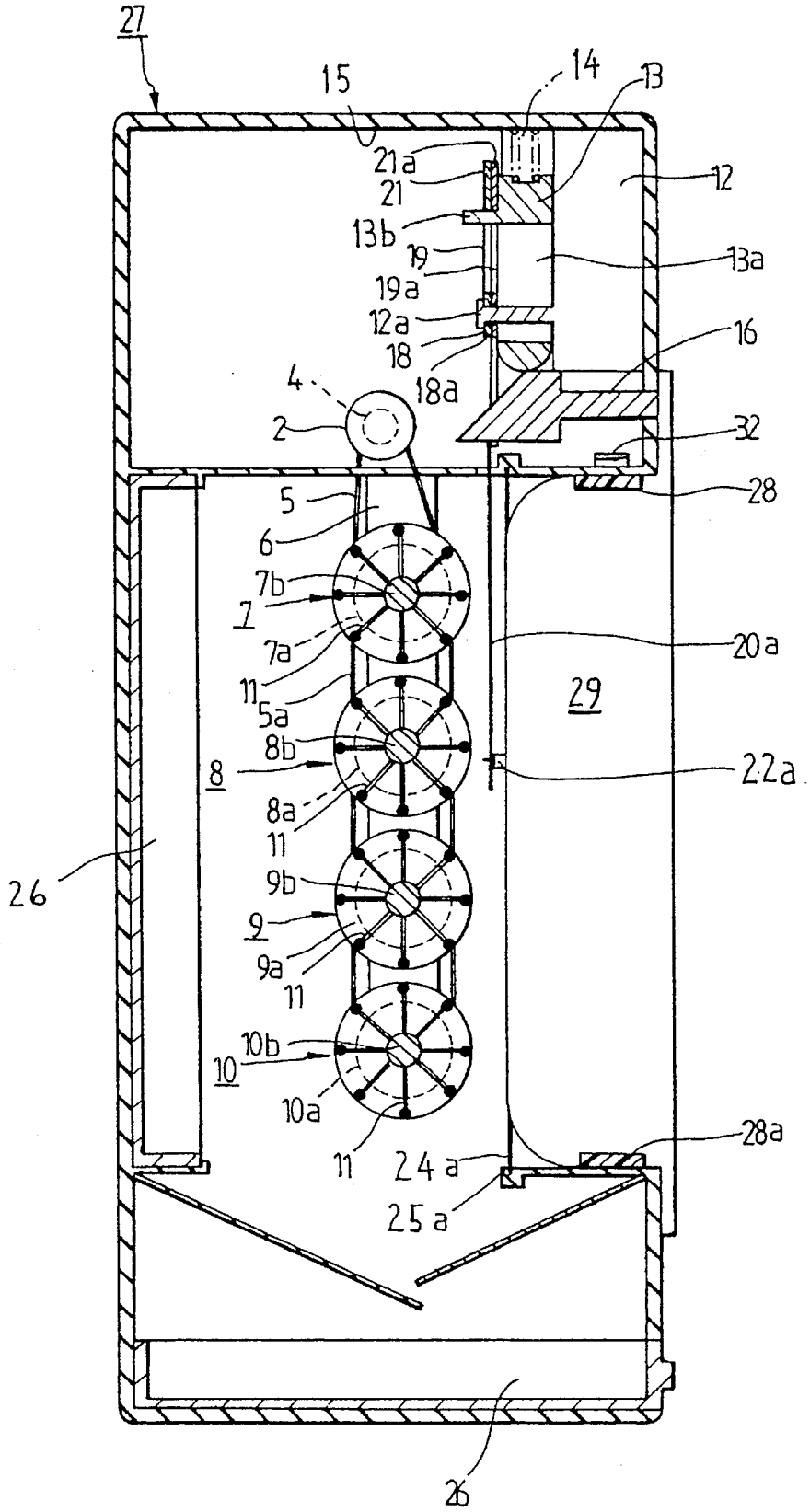
FIG. 5 shows a longitudinal sectional view of FIG. 3.

Further, when the operation, as stated above, is finished and the eraser 29 is taken out of opening 1 of the main body 27, as shown in FIGS. 2 to 4, the pressing force on the push button 16 is terminated and the push button 16 is returned to its original position by the elastic force of the tension spring 17. At the same time, the sliding member 13 is moved to the initial position thereof by the elastic force of the spring 14.

At this time, the switching members 21 and 21*a*, which are rotatably disposed on the fixed shaft 12*a* of the guide member 12, are moved toward one another caused by the operating shaft 13*b* which is integrally formed on the sliding member 13 returning to its initial position, the switching members 21 and 21*a* being rotated around the fixed shaft 12*a* to a position where the inclined grooves 19 and 19*a* in the switching members 21 and 21*a*, form a "V" shape, as shown on FIG. 2 and, through this rotation of the switching members 21 and 21*a*, the open closure doors 23 and 23*a* are moved from the sides of the main body 27 to the center thereof by the elastic bars 20 and 20*a* of the switching members 21 and 21*a* to effect a closing of the doors.

Further, as shown in FIGS. 8 to 11, in the other embodiment of the invention, when the operation is finished as described above and the eraser 29 is taken out of the opening 1 of the main body 27, the magnetic forces for the magnets 28 and 28*a* attached to the eraser 29.

The sliding members 13 are returned to the original position thereof by the spring 41 and at the same time the operating shaft 13*b* which is integrally formed with the sliding members 13 is returned to its original position. By such movement, the organization of the inclined grooves 42 and 42*a* on the switching members 43 and 43*a* are changed from a "V" shape into an up-sidedown "V" shape around the fixed shaft 12*a* of the guide member 12 as the switching members 43 and 43*a* are rotated around the fixed shaft 12*a*.

Accordingly, through the rotation of the switching members 43 and 43*a*, the closure doors 23 and 23*a* are moved from the sides of the main body 27 to the center thereof by the elastic bars 20 and 20*a* of the switching members 43 and 43*a* and are finally closed.

As described above, the apparatus for the brushing of chalk powder off of the eraser surface of the blackboard eraser can be manufactured in a small and very convenient size, and can be oriented in any place without disruption to the setting place.

In addition, because the operation is stopped after the passage of a set time interval, the erasers now without chalk powder thereon still in the apparatus and the erasers with chalk powder thereon and in need of cleaning can be exchanged.

Further, dispersion of the chalk powder into the room air is prevented.

The embodiments of the invention in which an exclusive property or privilege is claimed are defined as follows:

1. An apparatus for brushing chalk powder off from an eraser surface of a blackboard eraser, comprising:

a housing having a means defining an opening into an interior of the housing and being adapted to receive the eraser surface of the blackboard eraser therein;

a driving means;

a plurality of parallel shafts rotatably supported in the housing, each shaft having eraser surface engaging brush elements thereon;

coupling means for coupling the drive means to the plural shafts;

switch means responsive to the presence of the blackboard eraser in said opening;

closure means supported for open and closed relation relative to the opening in said housing;

means for effecting a movement of the closure member to the open position relative to the opening in response to an entry of the eraser surface into the opening and an initiating of the rotation of the shafts to cause the brush elements to brushingly engage the eraser surface; and collecting means for collecting the chalk powder brushed off from the eraser surface.

2. The apparatus according to claim 1, wherein means are provided for effecting a back and forth rotation of the shafts.

3. The apparatus according to claim 1, wherein said switch means includes a push button projecting outwardly from the housing and is adapted to be pushed into the housing in response to the presence of a blackboard eraser in said opening.

4. The apparatus according to claim 3, wherein said means for effecting a movement of the closure member includes a slide member movable in response to the pushed in movement of the push button, said slide member including a linkage means interconnecting the slide member to the closure member.

5. The apparatus according to claim 4, wherein said linkage means includes a switching member pivotally supported on a guide member in said housing, said switching member having an elongated slot into which is slidingly received a shaft on the slide member, an elongation to the slot being inclined relative to the path of movement of the slide member.

6. The apparatus according to claim 5, wherein a pair of closure means is provided, wherein a pair of switching members is provided each linked through said linkage means to said shaft on said slide member and an elongated slot, and wherein the slot in each switch member forms a V-shape with the slot in the other switch member.

* * * * *